US006047917A

United States Patent [19]

Ekström et al.

[11] Patent Number: 6,047,917

[45] Date of Patent: Apr. 11, 2000

[54] REEL-UP

[75] Inventors: Göran Ekström, Väse; Roland Karlsson, Karlstad; Tommy Karlsson, Göteborg; Lars-Erik Önnerlöv, Karlstad, all of Sweden

[73] Assignee: Valmet-Karlstad AB, Sweden

[21] Appl. No.: 09/063,713

[22] Filed: Apr. 21, 1998

Related U.S. Application Data

[60] Provisional application No. 60/049,262, Jun. 10, 1997.

[30] Foreign Application Priority Data

Apr. 21, 1997 [SE] Sweden ..... 9701470

[51] Int. Cl.[7] ..... B65H 19/22; B65H 18/08; B65H 18/14; B65H 18/10

[52] U.S. Cl. ..... 242/541.3; 242/533.2; 242/534; 242/541.1; 242/541.4; 242/541.7; 242/542.3; 242/545

[58] Field of Search ..... 242/541.1, 541.3, 242/541.4, 541.7, 542.3, 545, 533.2, 534

[56] References Cited

U.S. PATENT DOCUMENTS

| | | | |
|---|---|---|---|
| 3,614,011 | 10/1971 | Karr . | |
| 4,143,828 | 3/1979 | Braun et al. . | |
| 4,175,714 | 11/1979 | Dreher . | |
| 4,283,023 | 8/1981 | Braun et al. . | |
| 4,934,619 | 6/1990 | Snygg . | |
| 5,370,327 | 12/1994 | Adamski | 242/533.1 |
| 5,375,790 | 12/1994 | Svanqvist | 242/541.1 |
| 5,393,008 | 2/1995 | Kyytsönen et al. | 242/541.1 |
| 5,520,354 | 5/1996 | Adamski | 22/541.1 |
| 5,531,396 | 7/1996 | Kinnunen et al. | 242/541.3 X |
| 5,673,870 | 10/1997 | Fielding et al. | 242/542.3 |
| 5,816,528 | 10/1998 | Ekström . | |
| 5,875,990 | 3/1999 | Svanqvist et al. | 242/542.3 |

FOREIGN PATENT DOCUMENTS

| | | |
|---|---|---|
| 1 574 632 | 1/1968 | Germany . |
| WO 93/24401 | 12/1993 | WIPO . |
| WO 96/06033A1 | 2/1996 | WIPO . |
| WO 96/15059 | 5/1996 | WIPO . |
| WO 97/13714 | 4/1997 | WIPO . |

OTHER PUBLICATIONS

U.S. Pat. application Ser. No. 08/991,280, pending assigned to assignee of the present application.

*Primary Examiner*—John Q. Nguyen
*Attorney, Agent, or Firm*—Alston & Bird LLP

[57] ABSTRACT

A reel-up in which paper is reeled up on reeling drums to form paper reels is provided. The reel-up comprises two stand members provided with stand rails to support the reeling drum. A secondary system consisting of first and second secondary units for receipt of new reeling drums is provided adjacent to the stand members. Each secondary unit comprises a first and a second secondary member, each arranged adjacent one of the stand members. Both secondary members of each secondary unit are arranged at the outer sides of the stand members so that the deleterious effects of paper dust, etc. between the stand members are eliminated.

20 Claims, 7 Drawing Sheets

REEL-UP

CROSS-REFERENCE TO RELATED APPLICATIONS

This application claims the benefit of U.S. Provisional Application Ser. No. 60/049,262, filed Jun. 10, 1997.

FIELD OF THE INVENTION

The present invention relates to papermaking machines and more particularly relates to reel-ups for reeling up a paper web as the web exits a papermaking machine.

BACKGROUND OF THE INVENTION

For reeling a continuous paper web from a paper machine to a paper reel, reel-ups have been used hitherto which are generally designed having two systems to enable continuous production to be maintained, namely a primary system which takes over an empty reeling drum from a pair of lowering arms and, when the paper web has been wound a few turns on the drum, a secondary system where reeling is continued to a finished reel of paper. In the present context we have chosen to use the adjective "secondary" in the terms "secondary system", "secondary unit", "secondary member", "secondary body", etc., even if the reel-up does not have a primary system. The secondary system usually comprises either a pair of secondary arms or a pair of secondary carriages which are pivoted or displaced linearly depending on the increase in diameter of the paper reel.

In reel-ups of the first type, i.e., with secondary arms, the reeling occurs, briefly, as follows: An empty reeling drum is transferred from a stock of drums to primary forks which bring it into contact with a driven surface winding drum over which the web runs, in order to initiate reeling of the web. Considerable friction thus occurs between the reeling drum and the surface winding drum, so that the reeling drum is generally caused to rotate at the same speed as the surface winding drum before coming into contact with this. The reeling drum is then moved along the periphery of the surface winding drum, down to two parallel, horizontal stand members where the secondary arms take over control of the reeling drum. Continued reeling to a finished reel is achieved in that the secondary arms, turning around a joint, follow the reel along its horizontal movement while press devices in the form of rotating, journalled press rolls, arranged on the secondary arms, act against bearing houses arranged on the end portions of the reeling drum. A desired, controllable linear pressure is thus maintained in the nip between the surface winding drum and the paper reel as it increases in size. However, the pivoting movement of the secondary arms causes the linear pressure to be uneven since the press reels press against the reeling drum in a contact point following the envelope surface of the bearing house in an arc-shaped movement, giving both a horizontal and a vertical movement component. Reel-ups with secondary arms are described in the following patent specifications, for instance: U.S. Pat. No. 4,143,828, U.S. Pat. No. 4,283,023, U.S. Pat. No. 4,175,714, U.S. Pat. No. 3,614,011 and U.S. Pat. No. 5,520,354.

Another deficiency in reel-ups with secondary arms is that the diameter of the finished paper reel is limited to the span of the secondary arms and if a large paper reel is required, secondary systems consisting of linearly movable secondary carriages provided with press devices must be used instead. The problem of the uneven linear pressure caused by the pivoting movement of the secondary arms is then also solved since the press devices on the carriages only have a horizontal movement component during movement of the reeling drum in relation to the surface winding drum. It is also less complicated to measure the growth of the reel with the aid of the horizontal movement of the carriage than with an angle transducer on a secondary arm. Reel-ups with linearly movable secondary carriages are described in the following patent specifications, for instance: U.S. Pat. No. 4,934,619 and U.S. Pat. No. 5,370,327.

With increasing reeling velocities and increasing size of the paper reel, however, slipping may occur between the surface winding drum and paper reel. Furthermore, the individual layers in the reel may be wound too loosely, particularly in the manufacture of soft paper such as "soft tissue" and similar paper used for sanitary purposes, since the linear pressure in the nip must be low to avoid negative effects in the paper reel, which may cause slipping between adjacent layers, causing them to be displaced axially along the paper layers below. These problems are solved by equipping the secondary system with central driving of the reeling drum. Central driving means that the reeling drum is connected to a drive means with the aid of a coupling device disposed at the ends of the reeling drum. Central driving also enables variation of the linear pressure within a wide area so that compression of the paper web in the nip between paper reel and surface winding drum can be reduced. Reel-ups with central driving are described in the following patent specifications, for instance: U.S. Pat. No. 4,934,619, U.S. Pat. No. 5,370,327, U.S. Pat. No. 5,520,354, U.S. Pat. No. 5,375,790 (SE-469 071) and U.S. Pat. No. 5,393,008 (SE-469 072).

In order to maintain the desired high stretchability in the tissue paper, an endless belt may be used as support means, either on its own or together with a surface winding drum. The endless belt also alleviates other control problems in the form of vibrations or the like in the web prior to the surface winding drum. Reel-ups with endless belts are described in the following patent specifications, for instance: U.S. Pat. No. 4,143,828, U.S. Pat. No. 4,283,023, U.S. Pat. No. 5,531,396 and U.S. Pat. No. 4,175,714.

With the use of central driving, a changeover must be effected between the different drive arrangements at the transfer of the reeling drum from the primary system to the secondary system, which affects the linear pressure negatively since a temporary pressure increase occurs in the nip. To optimize reeling, therefore, the same drive means should be connected throughout the reeling procedure from the start, with an empty reeling drum, to a finished reel so that the variation in tension otherwise occurring in the paper web can be eliminated. To achieve this it is already known to use double sets of secondary carriages only which alternate with each other and enable omission of the primary arms altogether. In this way a single drive means connected to one of the carriage pairs can follow the reeling drum throughout the reeling process to a finished reel. A reel-up of this type is described in U.S. Pat. No. 5,370,327. However, a special stand is required for the reel-up described therein to enable the carriage pairs to pass each other; i.e., the stand is provided with two pairs of parallel rails, pivotably journalled in the downstream end of the stand. The surface winding drum has also been arranged vertically movable. This means that the existing reel-ups cannot be directly equipped with double secondary units, nor can they easily be converted to reel-ups with double secondary units.

Furthermore, drive arrangements for central driving according to U.S. Pat. No. 5,370,327 have been arranged on each side of the stand, on separate support elements. The drive arrangements and each secondary unit have separate actuators for the to and fro movement along the separate support elements. The drive arrangement is also disconnected before the reeling drum has been grasped by the secondary unit. This creates difficulties when aligning and coupling together the reeling drum with the central driving during operation. As will be understood, the stand and support elements, arranged beside each other, also require a considerable amount of space.

When the reeling drum runs along the stand rails during production of a new paper reel there is risk of foreign bodies, e.g., collected dust from the paper web, preventing or obstructing the horizontal movement. A common problem associated with the above-mentioned reel-ups is therefore the difficulty in gaining easy access to the internal parts of the reel-up for repair, service and cleaning.

Finally, another major problem common to all known reel-ups, both with and without primary systems, is undesired friction forces which complicate control of the linear pressure in the nip between drum and the growing paper reel. In a reel-up with a linear loading system comprising horizontally movable secondary units for the reeling drum, it is the friction between reeling drum and stand rails, the stand-rail friction, that causes the greatest limitation of accuracy and reliability in controlling the linear pressure in the roll nip.

SUMMARY OF THE INVENTION

These and other deficiencies of the prior art are overcome by the reel-up according to the present invention wherein both secondary members of each secondary unit are arranged at the outer sides of the stand members. One of the two secondary members is located at each stand member and is arranged at a predetermined distance from the outside of the stand member in order to form a space therebetween. The other of said two secondary members located at each stand member is arranged close to the outside of the stand member and has an axial extension in relation to the reeling drum that is less than said predetermined space to permit passage of the second secondary member through said space. As such, no rails, carriages or the like are necessary between the stand members for supporting the reeling drums and the deleterious effects of paper dust, etc. are eliminated.

Each secondary body comprises a bottom plate, journalling elements carried by the bottom plate, and a pivot unit pivotably journalled in said journalling element for turning about an axis of pivot that is parallel with a reeling drum operating in the reel-up. The pivot unit is pivotable between a collection position folded up from the bottom plate for collection of an empty reeling drum and a production position folded down to the bottom plate for reeling the web onto the collected reeling drum. A press device is carried by the pivot unit for engaging the reeling drums.

Some of the immediate advantages gained with a reel-up having all secondary members arranged on platforms on the outsides of the stand members and comprising pivotable units able to lift the reeling drum from the stand rails are that repairs, service and cleaning of the components while production of a paper reel is in progress are greatly facilitated since the service staff no longer need to be on the inside of the stand construction. Total friction is also reduced in the secondary system thanks to elimination of the stand-rail friction. Further, the linear pressure is not affected by any temporary pressure increase due to a transmission shifting when transferring the reeling drum from the primary to the secondary system.

BRIEF DESCRIPTION OF THE DRAWINGS

The invention will be described in more detail in the following with reference to the drawings.

DETAILED DESCRIPTION OF THE INVENTION

Figure 1:
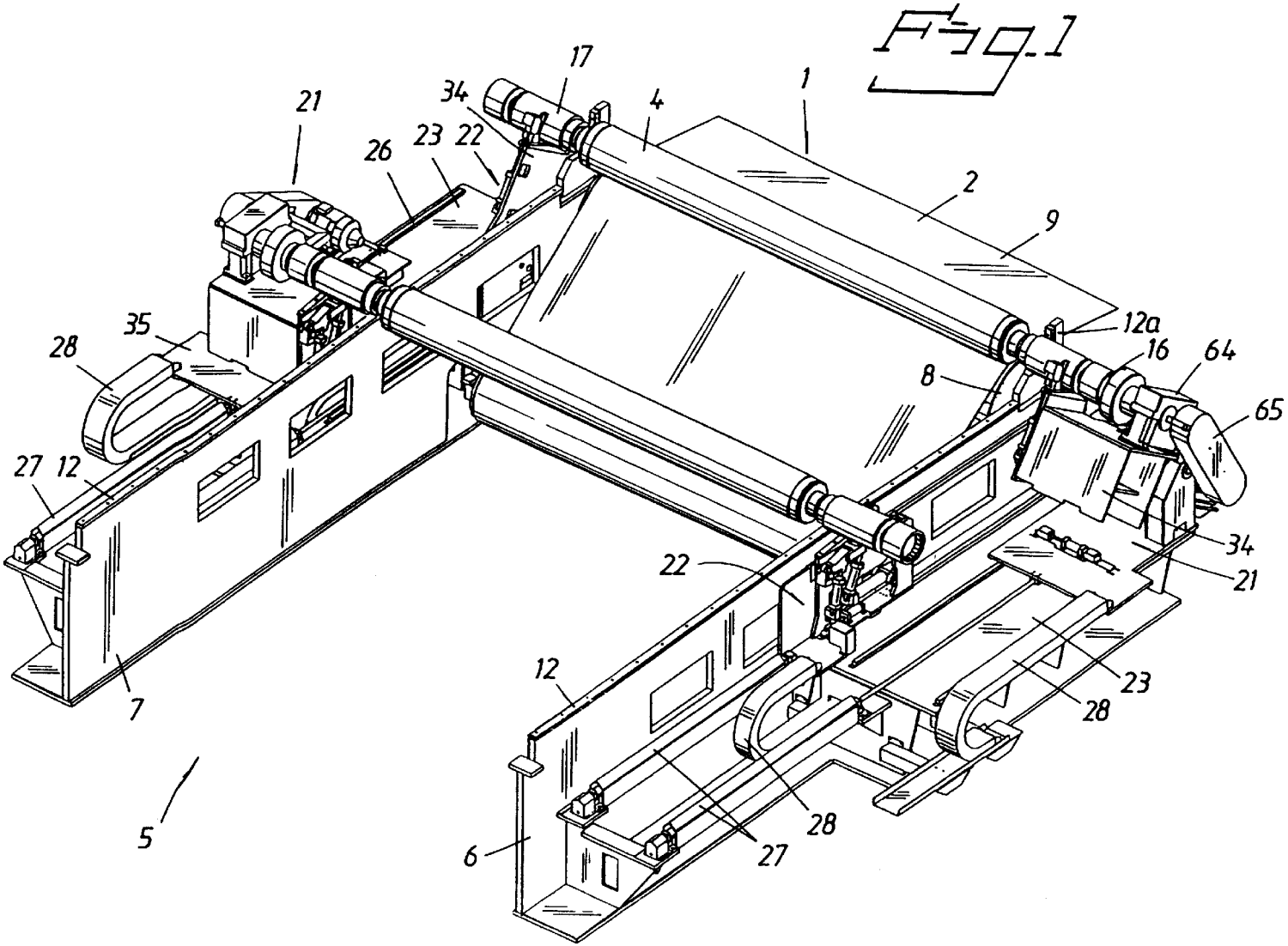
FIG. 1 is a schematic perspective view of parts of a reel-up according to the invention seen from one long side of the reel-up, the drive side, and comprising an endless, running belt and double secondary units.

FIGS. 1–5 show schematically various views of parts of a reel-up 1 in a paper machine in which paper is manufactured in a continuous web 2. A paper reel 3 is reeled in the reel-up 1 onto a core in the form of a reeling drum 4 (see FIG. 5; the paper reel has been omitted in FIGS. 1–4 for the sake of clarity). The reel-up 1 has a stand 5 comprising first and second elongate stand members 6, 7, located in parallel and having outer sides facing away from each other. The first stand member 6 is disposed on the drive side and the other stand member 7 on the operator side of the reel-up.

A surface winding drum 8 is rotatably journalled in the stand members 6, 7. Over the surface winding drum 8 runs an endless belt 9 which supports the paper web 2 coming from a drying section with a through-blow cylinder and/or Yankee cylinder in a tissue paper machine, on its way to the reel-up 1. A drive motor (not shown) gives the surface winding means 8 a peripheral speed corresponding to that of the belt 9 and thus also the speed at which the paper web 2 is fed forward. The surface winding drum 8 may alternatively be driven by the belt 9 which runs over a plurality of rolls 10 one of which, e.g., the belt turning roll 11, is then driving.

A horizontal rail 12 is also rigidly mounted above each stand member 6, 7. The rail 12 commences with a raised part 12*a* with a lowering surface 13 (see FIGS. 1, 2 and 5) for the reeling drum 4 in the upstream end of the reel-up 1, seen in the feed direction of the paper web 2. The stand rails 12 are arranged slightly further apart from each other than the width of the paper web 2. The reeling drum 4 is provided at each end with a braking drum 14 comprising a coupling device 15 with internal toothed rim 16 and a bearing house 17 situated inside the coupling device 15 and provided with a groove 18 running peripherally around it to receive the stand rail 12 or other guide element as described below.

At the upstream end of the reel-up 1, above the surface winding drum 8, is a stock of empty reeling drums 4 (not shown). The stock comprises a substantially horizontal shelf on which empty reeling drums 4 rest side by side and parallel to the surface winding drum 8, ready for use in the reel-up 1. Actuating means (not shown) comprising support arms and an actuator, such as a hydraulic or pneumatic cylinder, control the gradual forward feeding of new reeling drums 4. An empty reeling drum 4 is transferred from this stock to the lowering surfaces 13 of the above-mentioned raised parts 12*a* of the rails 12 by a pair of lowering arms when the growing paper reel 3 located downstream approaches a predetermined size. The reeling drum 4 rests with its peripheral grooves on the lower surfaces 13. At the downstream end of the reel-up 1 is a braking station (not shown) with a braking arm, in which braking station the paper reel 3 is finally retarded before being carried further along the stand rails 12 to a reel handling section (not shown) of the machine. A cutting device (not shown) may possibly be arranged upstream of the surface winding drum 8, which cuts the paper web 2 into several narrower paper webs prior to reeling.

The reel-up 1 comprises a secondary system consisting of a first secondary unit 19 and a second secondary unit 20, said secondary units being reversed in relation to each other with respect to the tender side and drive side of the reel-up 1. Each secondary unit 19, 20 has a first secondary member 21 and a second secondary member 22.

In the embodiment shown the first secondary member 21 of each secondary unit 19, 20 is arranged at a predetermined distance from the outer side of the first stand member 6 or the second stand member 7, respectively, to form a space therebetween, whereas each second secondary member 22 is arranged close to the outside of the other second stand member 7 or the first stand member 6, respectively, and has an axial extension in relation to the reeling drum 4 that is less than said predetermined space to permit passage of the second secondary member 22 through said space. According to an alternative embodiment, if central driving is not to be used, both secondary members of one secondary unit may be arranged at said predetermined distance from the outside of respective stand members, whereas both secondary members of the other secondary unit are arranged close to the outside of respective stand members.

Each secondary member 21, 22 comprises a platform 23 and a secondary body 24 in the form of a carriage or sledge movable linearly on the platform 23 with the aid of journalling means. In the embodiment shown the two platforms 23 of two adjacent secondary members 21, 22 belonging to different secondary units 19, 20, are combined to a unit which is rigidly mounted on its stand member 6, 7. Said journalling means comprise one or more parallel tracks 26 on the platform 23 and bearings suitably consisting of roller or sliding bearings, in order to reduce to a minimum the friction during the to and fro movement of the secondary carriage 24 along the platform 23. The other secondary member 22 of each secondary unit 19, 20 is also provided with similar journalling means comprising bearings in the secondary carriage 24 and a horizontal track 26 mounted on the vertical outer side of the stand member 6, 7 a short distance below the stand rails 12. Movement of the secondary carriage 24 is effected by an actuator 27 which may consist of a hydraulic or pneumatic cylinder, for instance, attached by one end to the secondary body 24 and by its other end to the stand member 6, 7. The movements along the guide tracks 26 of the two secondary bodies 24 in one and the same secondary unit 19, 20, respectively, are synchronized with one another. Cables are arranged on each platform 23 in a cable package 28 which is flexible, allowing it to follow the to and fro movements of the secondary body 24.

Each secondary carriage 24 comprises a pivot unit 34 arranged to lift the reeling drum 4 to a raised position where it is free from the stand rails 12. Thus the load from the reeling drum 4 and the paper reel is transferred throughout the production phase to the stand members 6, 7 via said journalling means, thereby eliminating stand-rail friction. At the end of the reeling process the paper reel 3 is transferred to the stand rails 12, together with its reeling drum 4 for further transport to the reel-handling part of the reel-up 1. Alternatively, if so desired, the reeling drum 4 may be in contact with the stand rails 12 during the entire reeling process or specific parts thereof, up to the reel passage described below.

Figure 6:
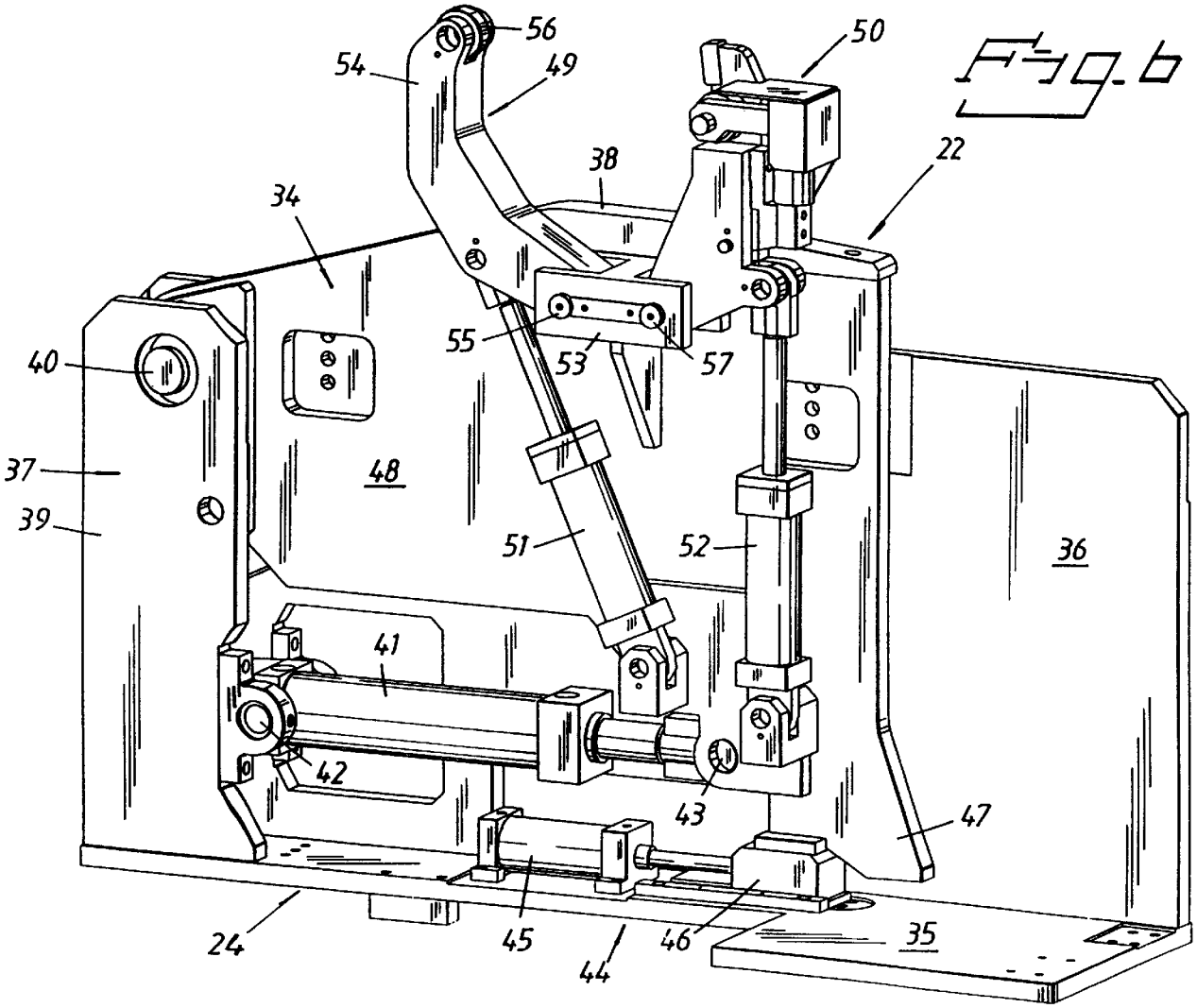
FIG. 6 is a perspective view of a second secondary member of one secondary unit of the reel-up according to FIG. 1.
Figure 7:
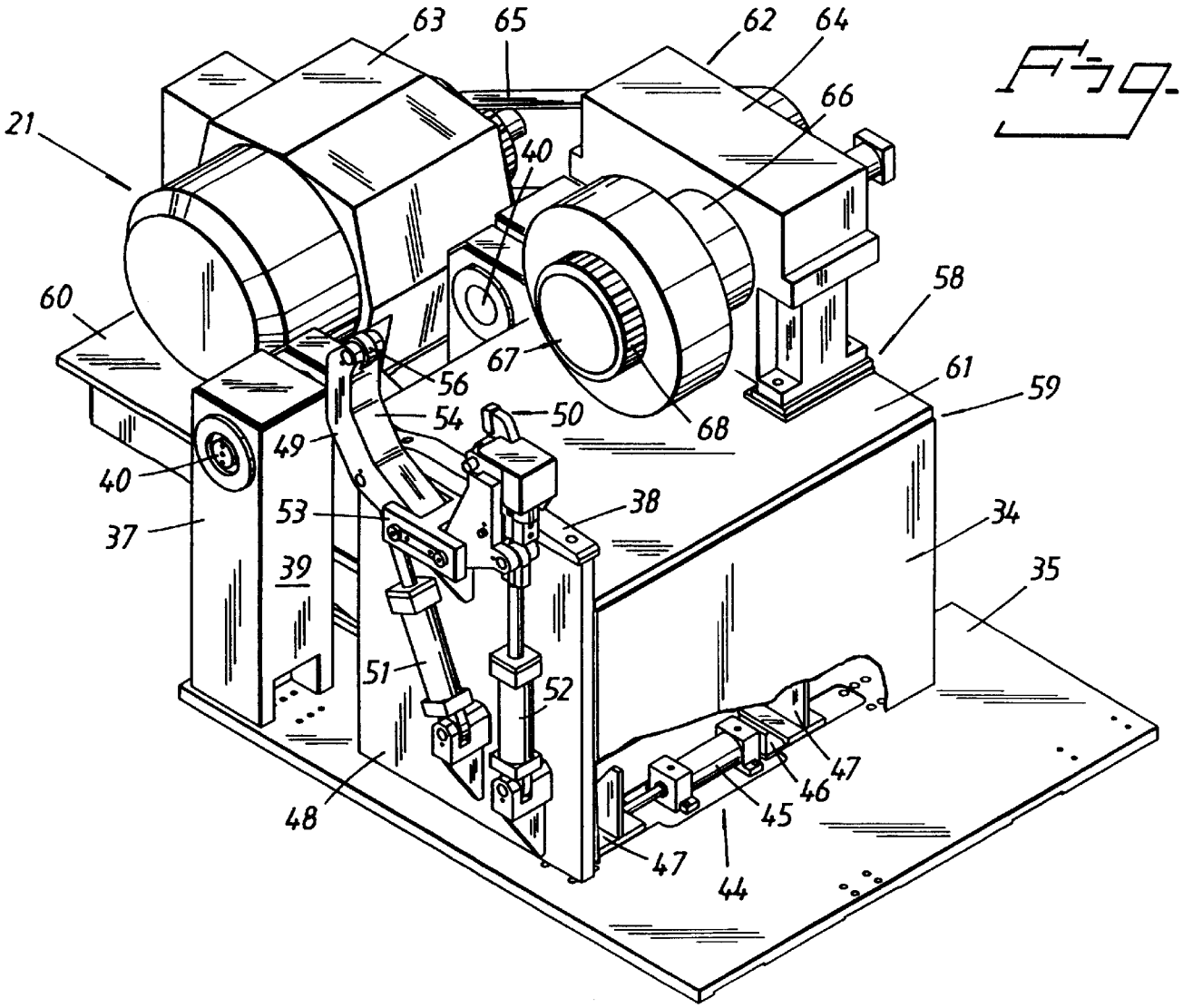
FIG. 7 is a perspective view of a first secondary member of a secondary unit in the reel-up according to FIG. 1 with a section of a box part cut away in order to show a position-determining member with its actuator.

Besides the pivot unit 34 for cooperation with the reeling drum 4, each secondary carriage (see FIGS. 6 and 7) also comprises a bottom plate 35 with journalling elements 37 for pivotable journalling of the pivot unit 34 about an axis of pivot that is parallel with an active reeling drum 4. The two pivot units 34 of the secondary unit 19, 20 are arranged to receive the reeling drum 4 from said lowering arms so that the end portions of the reeling drum 4 rest with their bearing houses 17 on the pivot units 34.

Each pivot unit 34 comprises a substantially rectangular, vertical support plate 48, a locking member 49, a press device 50 and actuators 51, 52 for each of these. The press device 50 is intended to press against the bearing house 17 of the reeling drum 4 so that a predetermined linear pressure is maintained in the nip between the surface winding drum 8 and the paper reel 3 during growth of the latter. Said support plate 48 is provided or shaped with a rail 38 located parallel with the said rail 12 and arranged to cooperate with the reeling drum 4.

An H-shaped connecting element 53 is rigidly secured horizontally along one long side to the support plate 48. The locking device 49 consists of an arc-shaped arm 54 hinged at its lower end to the above-mentioned H-shaped connecting element 53 by a horizontal bearing pin 55 extending parallel to the central axis of the reeling drum 4, between the two legs of the H-shaped connecting element 53 arranged upstream. The actuator 51 of the locking member 49 extends between a lower attachment point on the support plate 48 of the pivot unit and the locking arm 54 and is joined to these at the ends in hinged manner. The free upper end of the locking device 49 supports a roll 56 designed to cooperate with the axis of the reeling drum 4 when the locking member 49 is in its upper production position.

The press device 50 is situated immediately opposite the locking member 49 in the two legs of the H-shaped connecting element 53 and is connected therewith in hinged manner in the same way as the locking member 49. The press device 50 is also pivotably journalled by means of a bearing pin 57, influenced by an actuator 52 extending between the press device 50 and the support plate 48 of the pivot unit 34. The locking member 49 and press device 50 of the two secondary members together form a gripping device for the reeling drum 4. The reeling drum 4 is thus supported by the gripping devices 49, 50 while at the same time being freely rotatable within these throughout the entire reeling phase of the paper reel 3.

At the secondary carriage 24 of the other secondary member 22 (see FIG. 6), the bottom plate 35 is oblong in shape and a vertical side plate 36 is arranged along the edge of the bottom plate 35 disposed nearest to the stand member 6, 7. Said journalling element 37 comprises a beam 39 extending vertically up from the bottom plate 35 at the end nearest the surface winding drum 8, and a bearing pin 40 arranged at the upper end of the beam 39 and forming said axis of pivot. The pivot unit 34 is pivotable about said bearing pin 40 with the aid of an actuator 41 flexibly attached by one end to the lower end portion of the beam 39 and by its other end to the pivot unit 34 with the aid of guide pins 42, 43. The actuator 41 consists of a pneumatic or hydraulic piston cylinder.

On the bottom plate 35 is a position determiner 44 comprising an actuator 45 and a horizontally movable level block 46 for cooperation with a fixed, step-shaped shoulder 47 on the pivot unit 34. Since the level block 46 of the position determiner 44 can be set in two positions, one active and one passive, by means of the actuator 45, the vertical position of the pivot unit 34 can be set in an upper production position, in which each end of the reeling drum 4 rests with its bearing house on the rail 38, and a lower reel-exchange or free-passage position in which the rails 38 of the pivot units 34 are below the upper edge of the stand rails 12. This allows the secondary unit 19 or 20 on its way back after having delivered a finished reel 3, to pass below the paper reel 3 in the process of being formed in the other secondary unit 20 and 19, respectively.

The outer secondary member 21 of each secondary unit 19, 20 is shaped somewhat differently from the second secondary member 22. The secondary carriage 24 of the first secondary member 21 is described in more detail with reference to FIG. 7, the same designations being used for equivalent construction elements. The secondary carriage 24 of the first secondary member is provided with a bottom plate which is somewhat larger than that of the second secondary carriage 24. Said journalling element 37 for pivotable journalling of the pivot unit 34 about a bearing shaft comprises two vertical beams 39, each arranged at one edge extending parallel to the stand member 6, 7, and two bearing pins 40 arranged at the upper end parts of the beams 39 and forming said bearing shaft. The actuator 45 of the position determiner 44 is arranged horizontally on the bottom plate 35 at right angles to the stand member 6, 7. The pivot unit 34 comprises a stand 58 with a box-shaped part 59 and a platform 60 projecting therefrom. The box part 59 is provided with an upper horizontal plate 61 on which parts of a means 62 for central driving of the reeling drum 4 are arranged. The vertical support plate 48 is rigidly mounted on the inner vertical wall of said box part 59 forming a part of the pivotable stand 58. Since the central drive means 62 is mounted on the pivot unit 34, it is linearly displaceable together with the secondary carriage 24 in a direction parallel to the rails 12 and is also pivotable together with said pivot unit 34 about its bearing pins 40.

The central drive means 62 comprises a drive motor 63 firmly secured on the platform 60, a transmission box 64 firmly secured to the box part 59 and a power transmission means 65 arranged between them which, in the embodiment shown, consists of a tooth belt. A rotatable shaft 66 projects from the transmission box 64 in a direction parallel to the reeling drum 4. A coupling device 67 is arranged on this shaft 66 at its inner end facing the stand member 6, 7. The coupling device 67 has an external toothed rim 68 designed to cooperate with a corresponding internal toothed rim 16 on the reeling drum 4. This cooperation between the two coupling devices 15, 67 is achieved by the coupling device 67 of the central drive means 62 being displaced coaxially in relation to the coupling device 15 until connection occurs.

Figure 2:
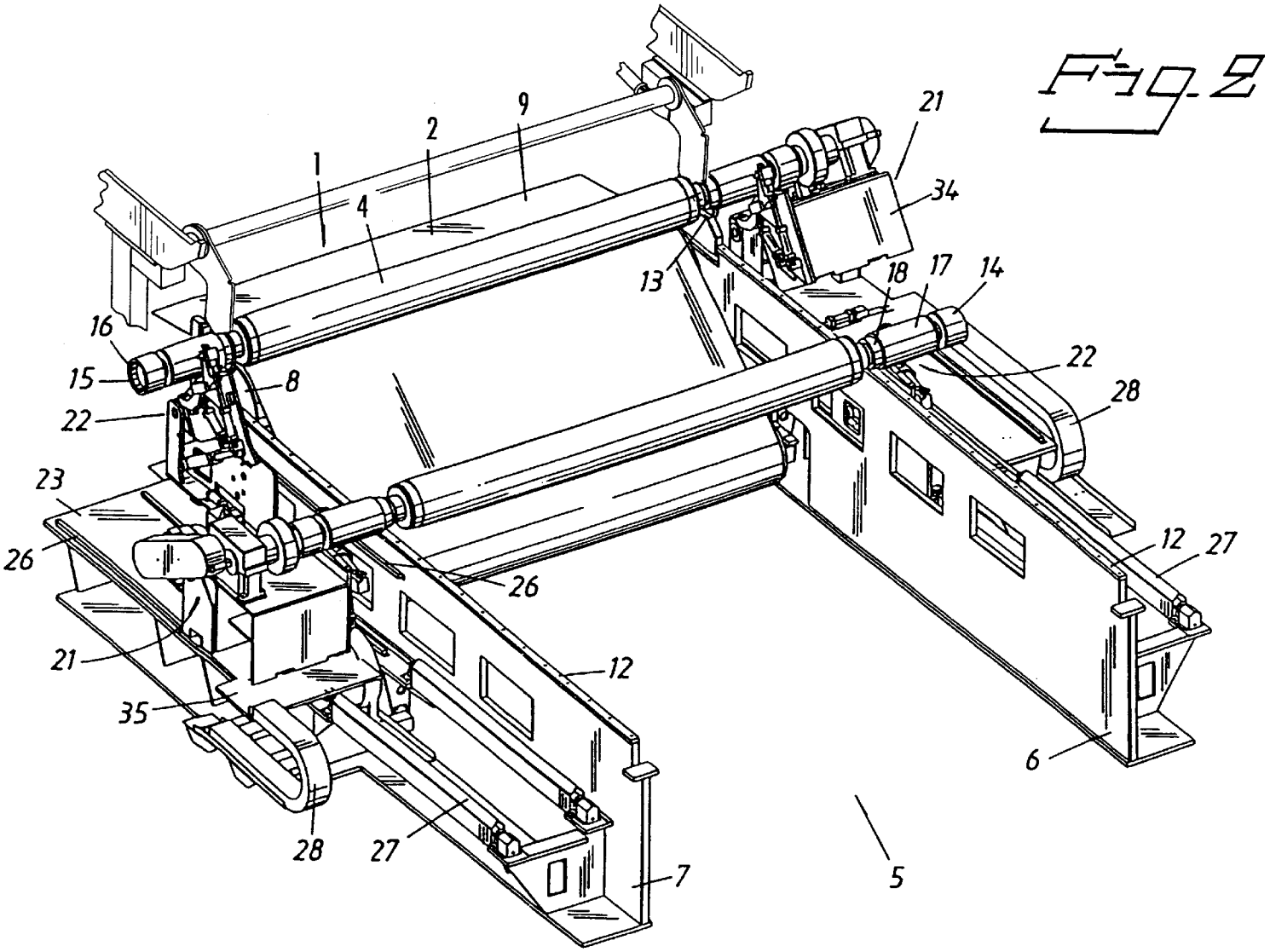
FIG. 2 is a schematic perspective view of the reel-up according to FIG. 1 seen from the opposite long side.
Figure 3:
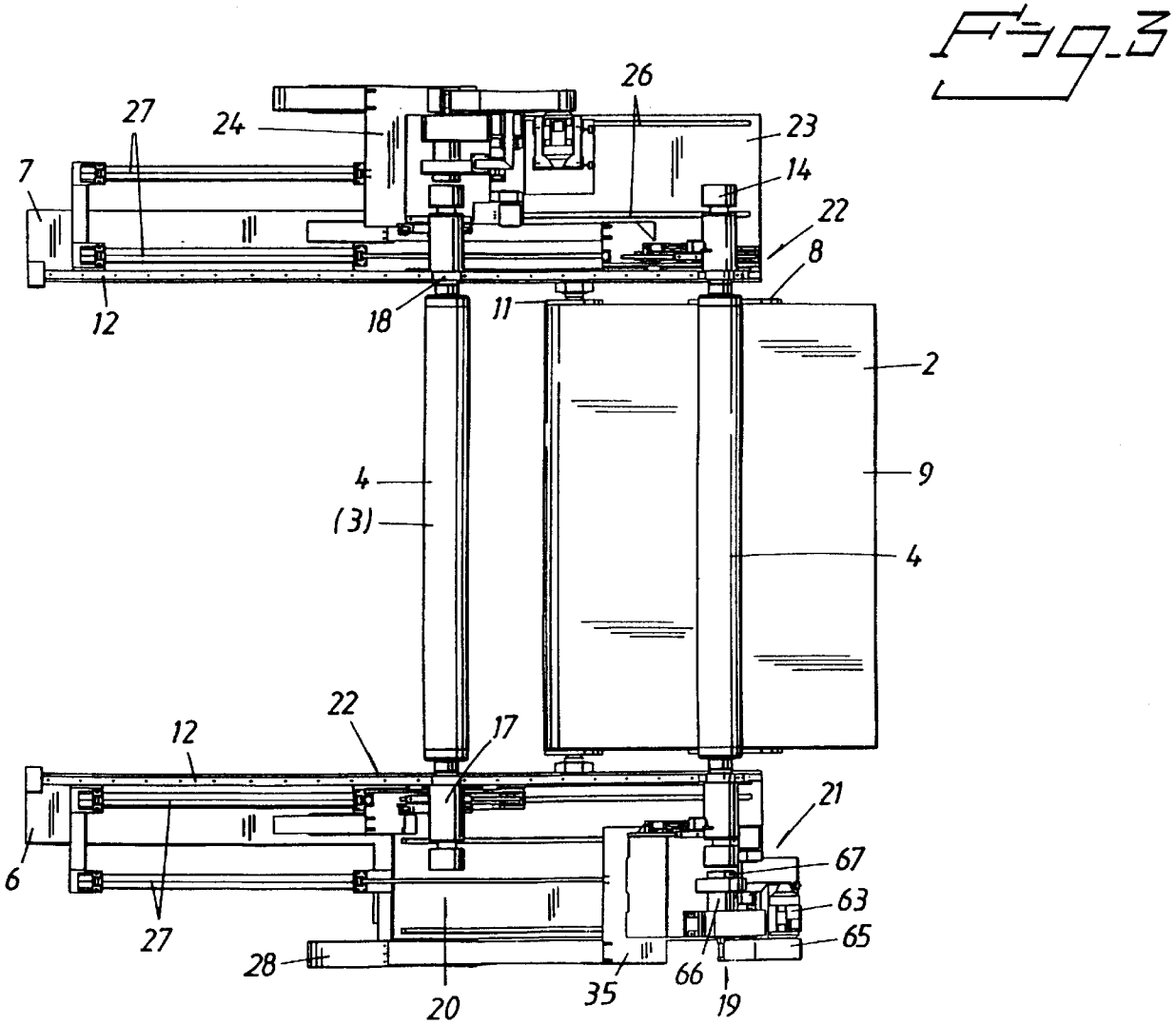
FIG. 3 is a view of the reel-up according to FIG. 1 seen from above.
Figure 4:
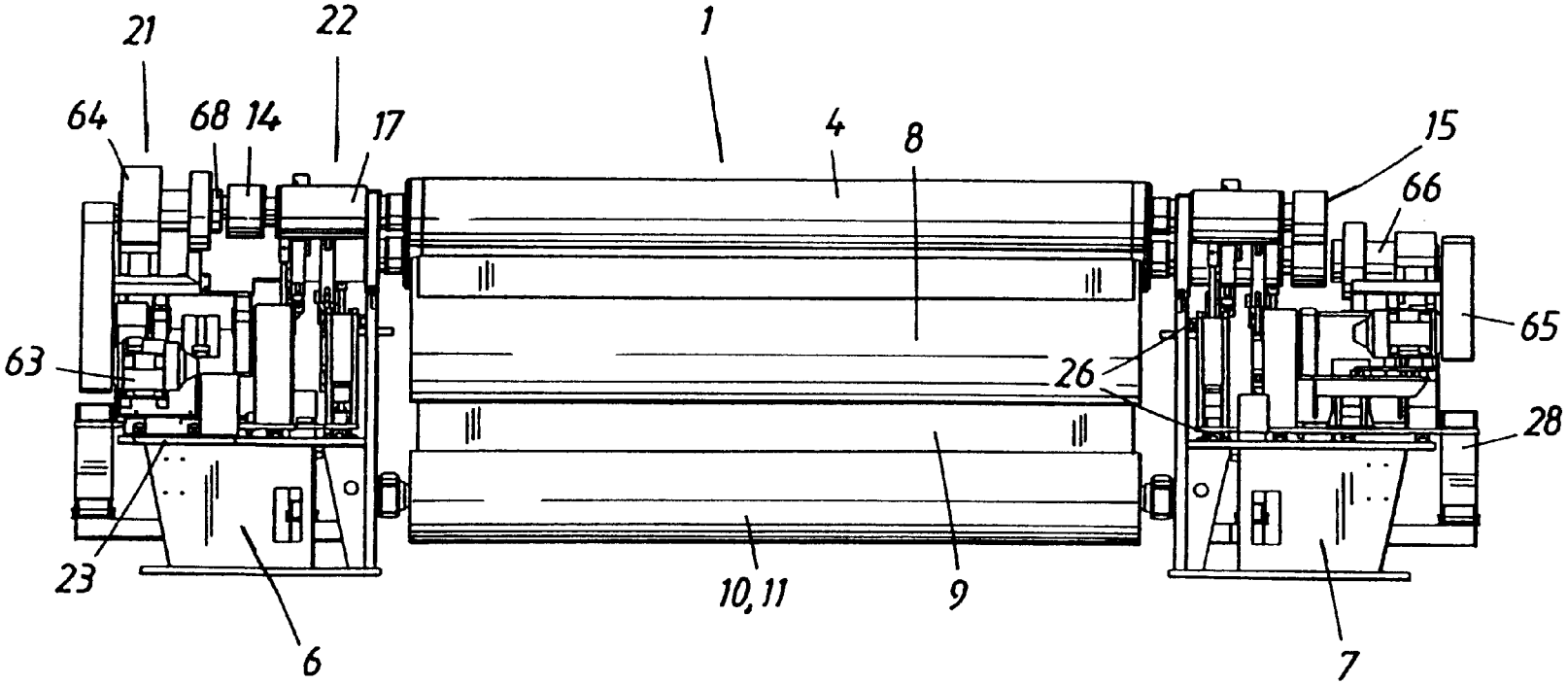
FIG. 4 is an end view of the reel-up according to FIG. 1 seen from the upstream end of the reel-up.

As is clear from FIGS. 1 and 2, each pivot unit 34 of a secondary member 21, 22 is arranged to be turned past the stand rails 12 from the lower position, the reel-passage position, in which the rails 38 of the pivot unit 34 are located below the stand rails 12, to an upper position, collect position, to receive and grasp an empty reeling drum 4 which has been placed on the lowering surfaces 13 to be subsequently supported by the rails 38 of the pivot units when the pivot units are turned back again. This turning movement is achieved with the aid of the actuator 41.

Unless, for reasons of safety or some other reasons, the reeling drum with its growing paper 3 must be lowered onto the stand rails 12, it is advantageous for the reeling drum 4 and paper reel 3 to be supported by the secondary carriages 24 via their rails 38 throughout the production phase from empty or substantially empty reeling drum to finished paper reel 3, after which the reeling drum with the finished paper reel 3 is lowered to the stand rails 12.

The reel-up is provided with various indication means (not shown) for different types of measured values, which constitute technology familiar to one skilled in the art and are therefore not further described here.

In other embodiments of the reel-up the surface winding drum in the embodiment described above may consist of an endless supporting belt, for instance, or a plurality of endless belts arranged parallel to each other.

When the reeling process is started up in the reel-up 1, the first secondary unit 19 is in its upstream position close to the surface winding drum 8 with the drive motor 63 of the central driving on the drive side and the other secondary unit 20 in its downstream position with the drive motor 63 of the central driving on the operator side.

The pivot units 34 of the first secondary unit 19 are in their production positions, i.e., in folded-down position resting on the level blocks 46. The pivot units 34 of the second secondary unit 20 are also in folded-down position, but rest directly on the bottom plate 35, which means that the reel-passage position has been assumed.

All locking members 49 and press devices 50 in the two secondary units 19, 20 are in folded-down position and thus with the gripping means open. The two central drive means 62 are stationary, with the coupling devices 67 in their outermost positions.

A first reeling drum 4 is on the stock shelf (not shown) above the surface winding drum 8, ready to be gripped by the lowering arms which are in their lowermost position. Downstream in the reel-up 1 the braking station is ready with lowered arm to receive and retard a finished paper reel 3. The cutting device, if any, is switched on but is not in production position.

When start has been initiated the pivot units 34 in the secondary unit 19 situated upstream are pivoted up to their upper position. The lowering arms move up to the drum stock. A reeling drum 4 is caused to roll over to the lowering arms and an indication is received when it has reached the correct position.

Figure 5:
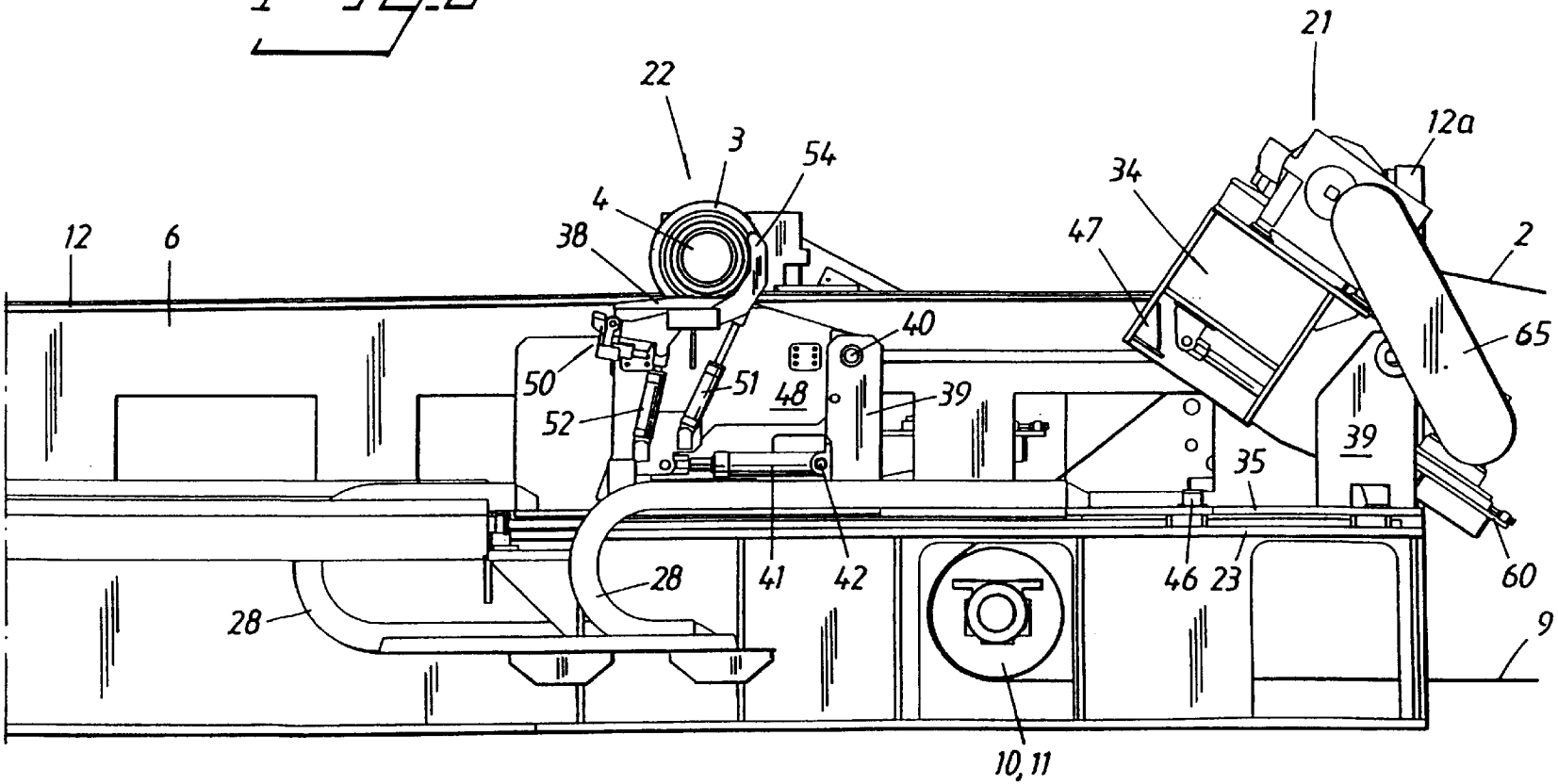
FIG. 5 is a side view of a part of the reel-up according to FIG. 1.

The lowering arms then move down to the delivery position where the reeling drum 4 is placed on the raised lowering surface 13 of the rails 12, in the correct position just above the surface winding drum 8 (see FIG. 5). In the stock the next empty reeling drum 4 is moved forward ready for the next cycle, by an actuator (not shown) provided for the purpose.

The press device 50 moves up to its collecting position. The lowering arms are lowered further so that the reeling drum 4 now rests freely on the rails of the lowering surface 13. The actuator 51 of the locking member 49 is actuated so that the locking arms 54 move up and, together with the press device 50, grip the reeling drum 4 and fix it in its starting position. The coupling device 67 of the central drive means 62 begins to move out in axial direction while the drive motor 63 is actuated, initially with low speed. When the toothed rims 16, 68 of the two coupling devices 15 and 67 have engaged and coupling has been achieved, this is indicated. A screen (not shown) to eliminate the effects of the air flow around the rotating surface winding drum 8 is lowered. The central drive means 62 now accelerates the reeling drum 4 to the same peripheral speed as that of the surface winding drum 8, in order to avoid friction when these are brought into contact with each other. The pivot units 34 are lowered towards the surface winding drum 8 and the endless belt 9 carrying the paper web 2.

A vacuum arrangement (not shown) may be connected to the reeling drum 4 which in that case is perforated. When contact is achieved with the paper web 2 a transition occurs, the paper web 2 being transferred in suitable manner to the reeling drum 4, see below.

The actual transition may be achieved in several different ways. The paper web 2 may by attached by means of suction, for instance, and pulled off at the vacuum perforations in the reeling drum 4, or the growing reel 3 may be retarded so that a surplus of paper 2 arises and is drawn into the nip where it is then pulled off. Alternatively glue or tape may be applied on the reeling drum 4.

If the paper web 2 is to be divided into several webs, the cutter is lowered and put into operation. The secondary carriages 24 are now positioned in succession outwardly from the surface winding drum 8 in order to obtain a constant impression in the endless belt 9. The first secondary unit 19 moves horizontally along the stand members 6, 7 as the paper reel 3 grows, whereas the secondary unit 20 starts to move upstream towards the surface winding drum 8. It passes below the growing reel 3 thanks to the clearance obtained between the secondary units 19, 20 with the aid of the position determiner 44 function, said position determiner 44 assuming a free-passage position.

After passage, when the second secondary unit 20 has reached its uppermost upstream position, the pivot units 34 pertaining to said second secondary unit 20 are rotated to their top position, whereupon the position determiner 44 is again set in production position by the actuator 45 moving the level block 46 to its front position. The lowering arms are again raised to collect a new empty reeling drum 4. In the meanwhile the growing reel 3 has achieved its final size and reached the braking station. The reel 3 is retarded to about 20% of production speed, whereupon the central drive means 62 is disconnected. The drive means is then stopped entirely and the reel is transferred to the reel-handling part (not shown) of the reel-up 1. The process then starts again.

In the embodiment shown the belt continues to support and also drive the paper web to the finished paper reel at the same time as the new reeling drum comes into contact with the belt and the paper web is wrapped around the new reeling drum, which is described in more detail in U.S. Pat. No. 5,531,396. According to an alternative embodiment, not shown, the new reeling drum is in contact with the endless belt whereas the finished reel leaves said belt on its journey downstream.

In the embodiment of the invention described above and shown in the drawings, the support means comprises a surface winding drum 8 and a belt 9. However it is also possible for the support means in a first extreme case to consist of only the surface winding drum 8, without the use of any belt 9, as in a conventional drum winder. In another extreme case the support means, as well as the belt 9, may also comprise a roll in the form of a guide roll 8 in which case the configuration is such that both the wrapping of the web 2 around a new reeling drum 4 and continued reeling of the web 2 on the reeling drum 4 are performed against a portion of the belt 9 that is not directly supported. The guide roll 8 does not therefore act as surface winding drum. If a belt is used the nose section may be inclined downwardly as shown in FIGS. 1 and 2 or may be a vertical section which is not however, shown. Alternatively the belt 9 may turn around the surface winding drum 8 and run back from this towards the drying section of the tissue machine.

What is claimed is:

1. A reel-up in a paper machine in which paper is produced in a continuous web and reeled up on reeling drums to form paper reels, said reel-up comprising:

two elongate parallel stand members, each defining an outer side opposite the other stand member, each of said stand members further having an upstream end and a downstream end;

a moving winding surface arranged at the upstream end of the stand members to carry the web and deliver the web to a reeling drum;

a primary device for moving empty reeling drums to a position adjacent to the parallel stand members to commence a reeling operation; and first and second pairs of secondary members for alternately receiving each empty reeling drum and engaging the reeling drum against the winding surface to wind the web onto the reeling drum, each of said pairs comprising;

a linearly movable first secondary member supported at the outer side of one of the stand members for supporting and enabling linear movement of one end of the reeling drum along a respective stand member, a linearly movable second secondary member supported at the outer side of the other stand member for supporting and enabling linear movement of the other end of the reeling drum along a respective stand member such that the reeling drum is moved by a pair of secondary members which are both arranged outside of the stand members, and wherein the first and second pairs of secondary members are positioned and arranged not to interfere with each other as the pairs of secondary members alternatively receive and engage the reeling drums against the winding surface.

2. A reel-up as claimed in claim 1 wherein one of the two secondary members at each stand member is supported at a distance from the outer side of the stand member in order to form a predetermined space therebetween, and wherein the other of the two secondary members is supported more closely to the outside of the stand member and has an axial extension in relation to the reeling drum that is less than said predetermined space to permit passage of the other secondary member through said space.

3. A reel-up as claimed in claim 2 wherein one of the first and second secondary members of a pair of secondary members is arranged at a distance from the outer side of one of the stand members and the other secondary member is arranged close to the outer side of the other stand member.

4. A reel-up as claimed in claim 1 wherein the primary device for moving reeling drums comprises a pair of lowering arms pivotably arranged in a stand between a first position folded up from the stand for collecting a new reeling drum and a second, folded-down position for delivering the reeling drum onto lowering surface elevated from the stand members.

5. A reel-up as claimed in claim 4 wherein the lowering arms are arranged to be turned to a third position so that the lowering arms are freed from the reeling drum after delivering the drum to the lowering surfaces.

6. A reel-up as claimed in claim 1 wherein the winding surface comprises at least one endless support belt running in a loop and arranged at the upstream end of the stand members.

7. A reel-up as claimed in claim 6 wherein the endless support belt is arranged to continue to support the paper reel and the paper web arriving at the reel as the reel grows in diameter.

8. A reel-up as claimed in claim 1 wherein the winding surface comprises a surface winding drum rotatable journalled in the stand members.

9. A stand arrangement for a reel-up in a paper machine in which paper is produced in a continuous web and reeled up on reeling drums by a winding surface to form paper reels, said reel-up comprising:

two elongate parallel stand members, each defining an outer side opposite the other stand member, each of said stand members further having an upstream end and a downstream end; and first and second pair of secondary members for alternately receiving each empty reeling drum and engaging the reeling drum against the winding surface to wind the web onto the reeling drum, each of said pairs comprising;

a linearly movable first secondary member supported at the outer side of one of the stand members for supporting and enabling linear movement of one end of the reeling drum along a respective stand member, a linearly movable second secondary member supported at the outer side of the other stand member for supporting and enabling linear movement of the other end of the reeling drum along a respective stand member such that the reeling drum is moved by a pair of secondary members which are both arranged outside of the stand members, and wherein the first and second pairs of secondary members are positioned and arranged not to interfere with each other as the pairs of secondary members alternately receive and engage the reeling drums against the winding surface.

10. A stand arrangement as claimed in claim 9 wherein one of the two secondary members at each stand member is supported at a distance from the outer side of the stand member in order to form a predetermined space therebetween, and wherein the other of the two secondary members is supported more closely to the outside of the stand member and has an axial extension in relation to the reeling drum that is less than said predetermined space to permit passage of the other secondary member through said space.

11. A stand arrangement as claimed in claim 10 wherein one of the first and second secondary members of a pair of secondary members is arranged at a distance from the outer side of one of the stand members and the other secondary member is arranged close to the outer side of the other stand member.

12. A reel-up in a paper machine in which paper is produced in a continuous web and reeled up on reeling drums to form paper reels, said reel-up comprising:

two elongate parallel stand members, each defining an outer side opposite the other stand member, each of said stand members further having an upstream end and a downstream end;

a moving winding surface arranged at the upstream end of the stand members to carry the web and deliver the web to a reeling drum;

a primary device for moving empty reeling drums to a position adjacent to the parallel stand members to commence a reeling operation; and first and second pairs of secondary members for alternately receiving each empty reeling drum and engaging the reeling drum against the winding surface to wind the web onto the reeling drum, each of said pairs comprising;

a linearly movable first secondary member for linear movement of one end of the reeling drum, said first secondary member having, a support member for supporting the first secondary member at the outer side of the respective stand member, a linear actuator for linearly moving the support member in a direction parallel to the stand member, a press device pivotally supported on the support member for engaging the end of the reeling drum, and an actuator for pivoting the press device between a collection position folded away from the support member and a production position where the press device is folded towards the support member, and a linearly movable second secondary member for linear movement of the other end of the reeling drum, said second secondary member having, a support member for supporting the second secondary member at the outer side of the respective stand member, a linear actuator for linearly moving the support member in a direction parallel to the stand member, a press device pivotally supported on the support member for engaging the end of the reeling drum, an actuator for pivoting the press device between a collection position folded away from the support member and a production position where the press device is folded towards the support member, and wherein the first and second pairs of secondary members are positioned and arranged not to interfere with each other as the pairs of secondary members alternately receive and engage the reeling drums against the winding surface.

13. A reel-up as claimed in claim 12 wherein the first secondary member of each pair further comprises a central drive arranged to be brought into engagement with and drive the respective reeling drum.

14. A reel-up as claimed in claim 13 wherein the central drive further comprises a drive motor, a shaft, and a coupling device arranged on said shaft for engagement of the reeling drum along the axis thereof.

15. A reel-up as claimed in claim 12 wherein each of said press devices is also pivotable from the production position down to a free-passage position such that the press devices of a pair of secondary members in the free-passage position can pass beneath a reeling drum engaged by the other pair of secondary members in the production position.

16. A reel-up as claimed in claim 15 wherein each secondary member further comprises at least one horizontally movable level block mounted to said support member and a cooperating shoulder connected to said press device, said level block movable between a first position wherein said press device is in the production position and a second position wherein said press device is in the free-passage position.

17. A reel-up as claimed in claim 15 wherein the press device is arranged to place the ends of an empty reeling drum directly on the stand members.

18. A reel-up as claimed in claim 12 wherein each press device further comprises a vertical support plate and a rail along an upper edge of said vertical support plate such that the ends of each reeling drum are at least partially supported by the rails during reeling of the paper web.

19. A reel-up as claimed in claim 12 wherein each secondary member further comprises a locking member cooperating with the press device for locking the reeling drum against translational movement relative to the secondary member.

20. A reel-up as claimed in claim 12 further comprising a load cell associated with each of said secondary members for sensing the linear pressure in the nip between the winding surface and the paper reel and varying the linear position of said press device in order to control the linear pressure.

* * * * *